US007221252B1

(12) United States Patent
Chang

(10) Patent No.: US 7,221,252 B1
(45) Date of Patent: May 22, 2007

(54) TRANSFORMER

(75) Inventor: Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/422,563

(22) Filed: Jun. 6, 2006

(30) Foreign Application Priority Data

Feb. 9, 2006 (TW) ..... 95104442 A

(51) Int. Cl.
*H01F 27/24* (2006.01)

(52) U.S. Cl. ..... 336/212

(58) Field of Classification Search ..... 336/65, 336/83, 170, 178, 180–183, 196–198, 212; 315/254, 276, 277–278
See application file for complete search history.

(56) References Cited

U.S. PATENT DOCUMENTS 2,578,395 A * 12/1951 Brooks ..... 307/149
4,547,705 A * 10/1985 Hirayama et al. ..... 315/219
4,587,506 A * 5/1986 Hoeksma ..... 336/178
4,931,761 A * 6/1990 Kijima ..... 336/160

* cited by examiner

*Primary Examiner*—Tuyen T. Nguyen

(57) ABSTRACT

A transformer structure is disclosed. The transformer comprises a primary winding coil, plural secondary winding coils, a first winding portion, plural second winding portions, plural partition plates, a channel, and a magnetic core assembly. The first winding portion is used for winding the primary winding coil thereon, and the plural second winding portions are used for winding the secondary winding coils thereon and disposed at two sides of the first winding portion. The plural partition plates are disposed between the first winding portion and the second winding portions, respectively, and each the partition plate has a slot. The channel penetrates the first winding portion, the second winding portions and the partition plates. The magnetic core assembly comprises an I-shaped magnetic core and a U-shaped magnetic core. The I-shaped magnetic core is received in the channel and the U-shaped magnetic core has plural protrusions inserted into the slots of the partition plates. Thereby, a leakage inductance of the transformer is adjusted by a distance between the protrusions of the U-shaped magnetic core and the I-shaped magnetic core received in the channel.

15 Claims, 8 Drawing Sheets

3

5

TRANSFORMER

FIELD OF THE INVENTION

The present invention relates to a transformer, and more particularly to a transformer having increased leakage inductance.

BACKGROUND OF THE INVENTION

A transformer has become an essential electronic component for various kinds of electric appliance. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are wounded around the bobbin 12. A tape 15 is provided for isolation and insulation. The magnetic core assembly 11 is generally shaped as an EE-type core, an EI-type core or an ER-type core. The middle portions 111 of the core 11 are embedded into the cylinder tube 121 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are superimposed with each other and wounded around the bobbin 12. As a consequence, there is less magnetic flux leakage generated from the primary winding coil 13 and the secondary winding coil 14. Under this circumstance, sine the coupling coefficient is increased, the leakage inductance of the transformer is reduced and the power loss upon voltage regulation is reduced, the electric conversion efficiency of a power converter is enhanced.

In the power supply system of the electric products for the new generation, for example LCD televisions, the transformer with leakage inductance prevails. The current generated from the power supply system will pass through a LC resonant circuit composed of an inductor L and a capacitor C. The inductor L is provided from the primary winding coil of the transformer. Meanwhile, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch and minimize the noise.

In order to increase the leakage inductance of the transformer, the primary winding coil should be separated from the secondary winding coil by a certain distance to reduce the coupling coefficient of the transformer. Referring to FIG. 2, a schematic exploded view of a transformer with leakage inductance according to prior art is illustrated. The transformer 2 principally comprises a bobbin 21, a primary winding coil 22 and a secondary winding coil 23. The bobbin 21 comprises a first side plate 211, a second side plate 212 and a winding member 213. A tape 24 is wound around the middle portion of the winding member 213 and has a width d. The winding member 213 is divided into a first winding portion 2131 and a second winding portion 2132, which are located at bilateral sides of the tape 24. The primary winding coil 22 and the secondary winding coil 23 are wound around the first winding portion 2131 and the second winding portion 2132, respectively. The first winding portion 2131 is separated from the first side plate 211 by wrapping a first side tape 25 on the winding member 213 between the first winding portion 2131 and the first side plate 211. Likewise, the second winding portion 2132 is separated from the second side plate 212 by wrapping a second side tape 26 on the winding member 213 between the second winding portion 2132 and the second side plate 212. For safety regulations, the tape 24 is used for isolation between the primary winding coil 22 and the secondary winding coil 23. Via the first side tape 25 and the second side tape 26, the primary winding coil 22 and the secondary winding coil 23 are electrically isolated from the conductors outside the transformer 2. As the width d of the tape 24 between the primary winding coil 22 and the secondary winding coil 23 is increased, the coupling coefficient is reduced and the leakage inductance of the transformer is increased. Under this circumstance, the resonant circuit of the power supply system will be conveniently controlled.

Although the transformer structure of FIG. 2 is advantageous for increasing the leakage inductance, some drawbacks still exist. As previously described, the magnitude of the leakage inductance is dependent on the width d of the tape 24 between the primary winding coil 22 and the secondary winding coil 23. Since the tape 24 is made of flexible material and fails to be firmly fixed, the structure of the transformer is readily distorted due to a long-term using period or serious vibration. Under this circumstance, the magnitude of the leakage inductance is reduced or unstable, and the resonant circuit of the power supply system will be adversely affected. Since these tapes are sticky and narrow in width, the procedures of wrapping the tape 24, the first side tape 25 and the second side tape 26 are labor-intensive and complicated. In addition, if the wrapping result is unsatisfied, the electrical performance of the transformer is impaired.

Since the tape 24, the first side tape 25 and the second side tape 26 are wrapped on the winding member 213 of the bobbin 21, the remaining area or volume for winding the primary winding coil 22 and the secondary winding coil 23 around the winding member 213 is limited and thus the heat-dissipating effect is usually insufficient. Furthermore, after the procedures of winding the coils and wrapping the tapes, a layer of insulating tape is additionally wrapped around the primary winding coil 22 and the secondary winding coil 23. The insulating tape also impairs heat dissipation of the transformer during operation. Moreover, since the melting point of the tape 24 is relatively lower, the operating temperature of the transformer is restricted by the melting point of the tape 24.

With increasing development of electronic technologies, the electric conversion efficiency of a power converter to be used in an electronic product is gradually demanding. For example, in a case that a voltage is intended to be converted from a low voltage (e.g. 400V) to a high voltage (e.g. 2,000V), for meeting the requirement of safety regulations, the distance between the primary winding coil and the secondary winding coil should be increased to avoid conduction between the primary winding coil and the secondary winding coil. Unfortunately, since the width d of the tape 24 is insufficient and the converted voltage is too high, the conduction between the primary winding coil and the secondary winding coil is possible.

In views of the above-described disadvantages, the applicant keeps on carving unflaggingly to develop a structure of a transformer according to the present invention through wholehearted experience and research.

SUMMARY OF THE INVENTION

An object of the present invention is to provide a transformer, which employs a partition plate to separate the primary winding coil and the secondary winding coil, or disposes the first winding portion and the second winding portion in the receptacles at different sides of the main body, respectively, to increase the distance between the primary winding coil and the secondary winding coil so as to increase the leakage inductance of the transformer. Moreover, the leakage inductance of the transformer can be adjusted through the distance between the protrusion of the U-shaped magnetic core and the I-shaped magnetic core, so as to enhance the electric safety and solve the defects of the prior art.

Another object of the present invention is to provide a transformer whose leakage inductance can be adjusted through the magnetic core assembly, so that it does not need to redevelop a new model for the bobbin, so as to reduce the manufacturing cost, time and labor.

According to an aspect of the present invention, there is provided a transformer structure. The transformer comprises a primary winding coil, plural secondary winding coils, a first winding portion, plural second winding portions, plural partition plates, a channel, and a magnetic core assembly. The first winding portion is used for winding the primary winding coil thereon, and the plural second winding portions are used for winding the secondary winding coils thereon and disposed at two sides of the first winding portion. The plural partition plates are disposed between the first winding portion and the second winding portions, respectively, and each the partition plate has a slot. The channel penetrates the first winding portion, the second winding portions and the partition plates. The magnetic core assembly comprises an I-shaped magnetic core and a U-shaped magnetic core. The I-shaped magnetic core is received in the channel and the U-shaped magnetic core has plural protrusions inserted into the slots of the partition plates. Thereby, a leakage inductance of the transformer is adjusted by a distance between the protrusions of the U-shaped magnetic core and the I-shaped magnetic core received in the channel.

In an embodiment, the slot of the partition plate has an opening on a top surface of the partition plate, and the protrusions of the U-shaped magnetic core are inserted into the slots from an upper side of the partition plates and disposed on the first winding portion and the second winding portions.

In an embodiment, the slot of the partition plate has an opening on a lateral side surface of the partition plate, and the protrusions of the U-shaped magnetic core are inserted into the slots from a lateral side of the partition plates and disposed at a side of the first winding portion and the second winding portions.

In an embodiment, the U-shaped magnetic core comprises two extensions disposed at two ends of the U-shaped magnetic core and contacting with two end parts of the I-shaped magnetic core.

In an embodiment, the protrusions are disposed between the extensions.

According to another aspect of the present invention, there is further provided a transformer structure. The transformer comprises a main body, a primary winding coil, plural secondary winding coils, a first winding portion, plural second winding portions and a magnetic core assembly. The main body comprises a first side, a second side, a first channel, a first receptacle communicating with the first side, plural second receptacles communicating with the second side, and plural openings. The second receptacles are disposed at two sides of the first receptacle, and a partition wall is disposed between the first receptacle and the second receptacles. The first winding portion is used for winding the primary winding coil thereon. The first winding portion is disposed in the first receptacle and has a second channel communicating with the first channel. The plural second winding portions are used for winding the secondary winding coils thereon and disposed in the second receptacles. Each the second winding portion has a third channel communicating with the first channel and a slot communicating with the opening of the main body. The magnetic core assembly comprises an I-shaped magnetic core and a U-shaped magnetic core. The I-shaped magnetic core is received in the first, second and third channels, and the U-shaped magnetic core has plural protrusions inserted into the slots of the second winding portions through the openings of the main body. Thereby, a leakage inductance of the transformer is adjusted by a distance between the protrusions of the U-shaped magnetic core and the I-shaped magnetic core received in the first, second and third channels.

In an embodiment, the first side is opposite to the second side.

In an embodiment, the U-shaped magnetic core comprises two extensions disposed at two ends of the U-shaped magnetic core.

In an embodiment, the protrusions are disposed between the extensions.

In an embodiment, the main body comprises plural indentations disposed at two sides of the main body and communicating with the first channel.

In an embodiment, two end parts of the I-shaped magnetic core are disposed in the indentations, and the extensions of the U-shaped magnetic core are disposed in the indentations and contacting with the two end parts of the I-shaped magnetic core.

In an embodiment, the main body further comprises plural blocks extending upwardly from a top surface of the main body for disposing the U-shaped magnetic core therebetween, and two ends of each the block extend to openings of the indentations.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 3(*b*) is a schematic diagram showing the assembled structure of the transformer in FIG. 3(*a*);

FIG. 4(*b*) is a schematic diagram showing the assembled structure of the transformer in FIG. 4(*a*);

FIG. 5(*b*) is a cross-section through the A-A' line in FIG. 5(*a*); and FIG. 5(*c*) is a schematic diagram showing the assembled structure of the transformer in FIG. 5(*a*).

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
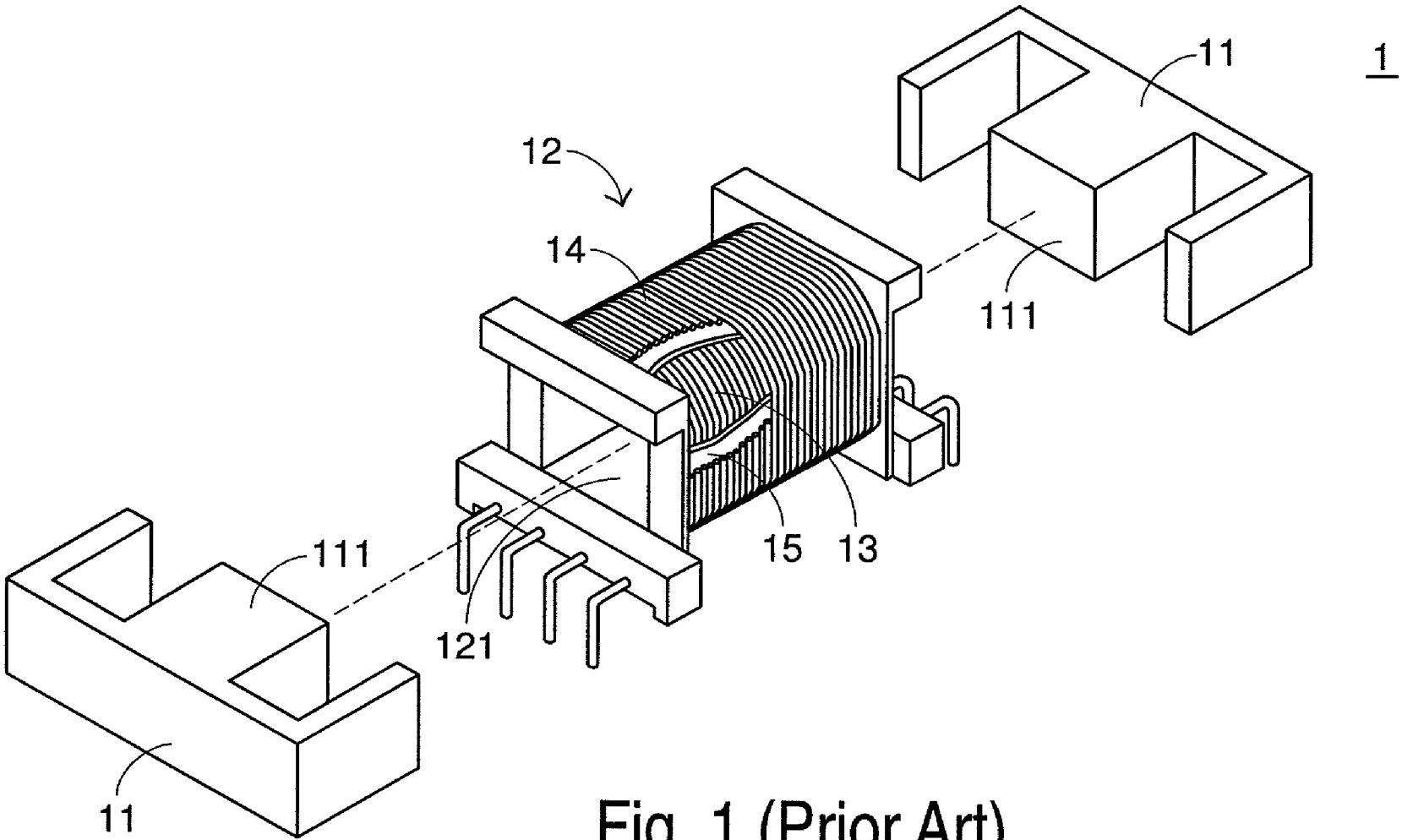
Fig. 1 (Prior Art)
FIG. 1 is a schematic exploded view of a conventional transformer.
Figure 2:
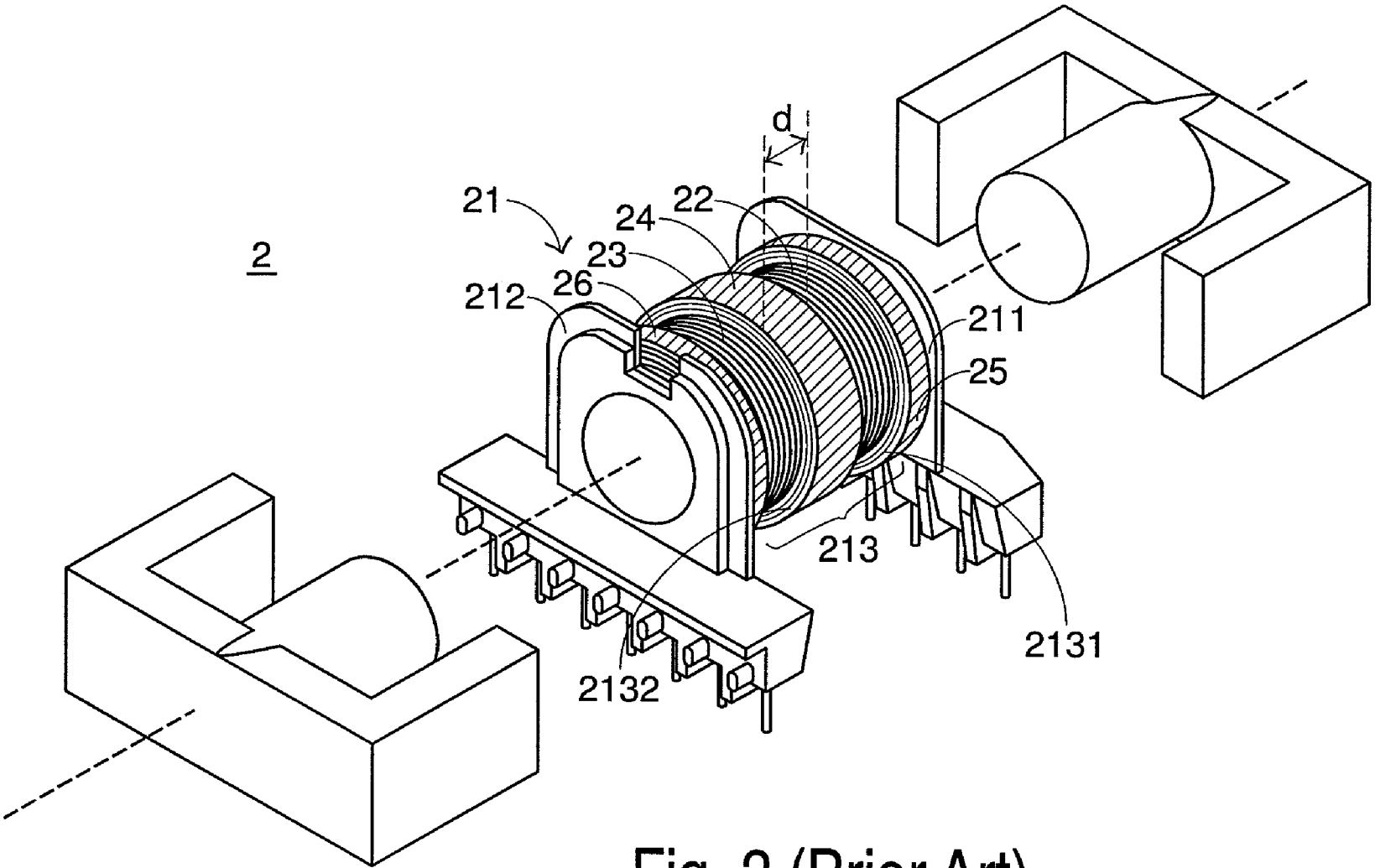
Fig. 2 (Prior Art)
FIG. 2 is a schematic exploded view of another conventional transformer.
Figure 3A:
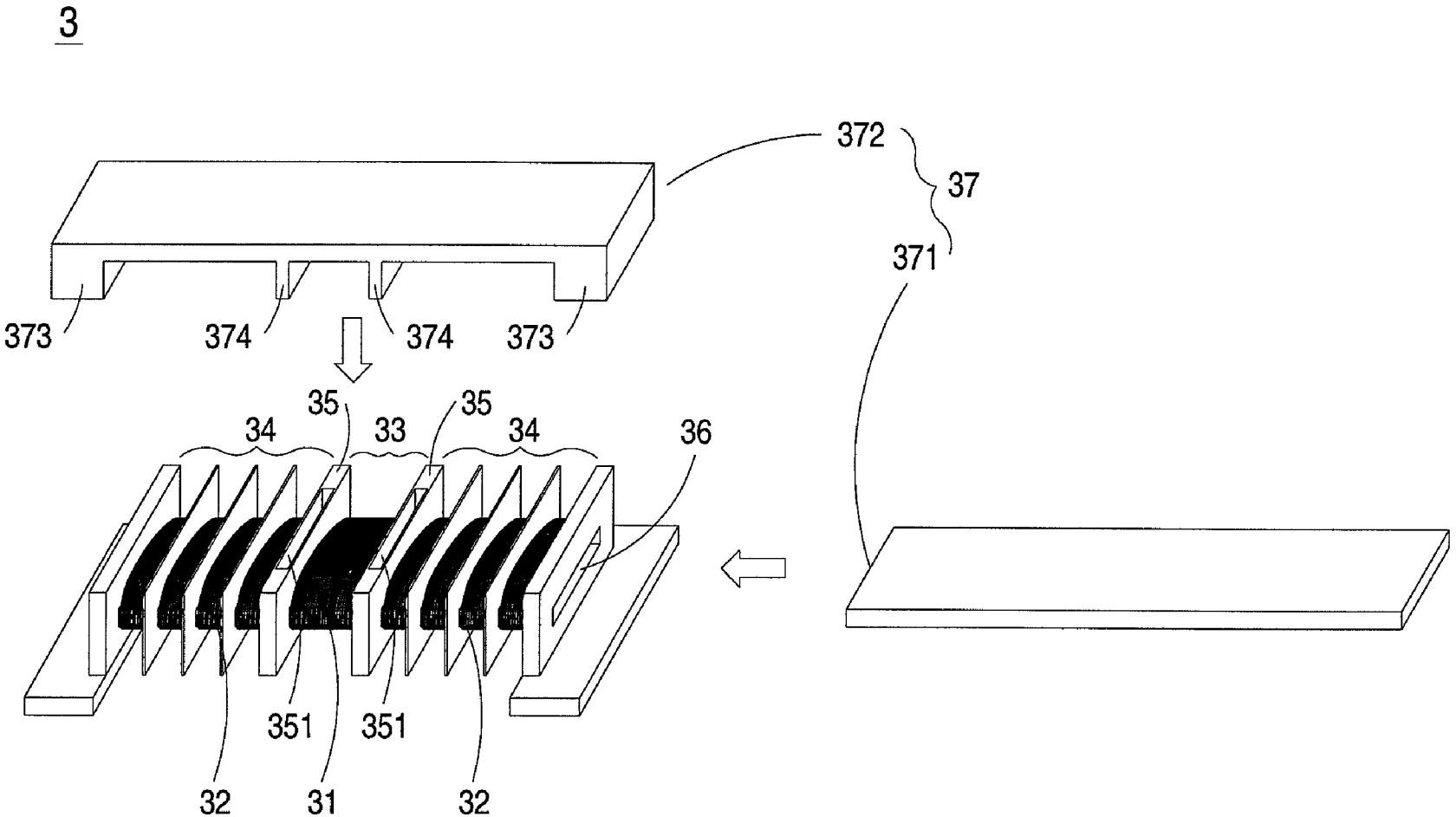
FIG. 3(*a*) is a schematic diagram showing the disassembled structure of the transformer according to the first preferred embodiment of the present invention.
Figure 3B:
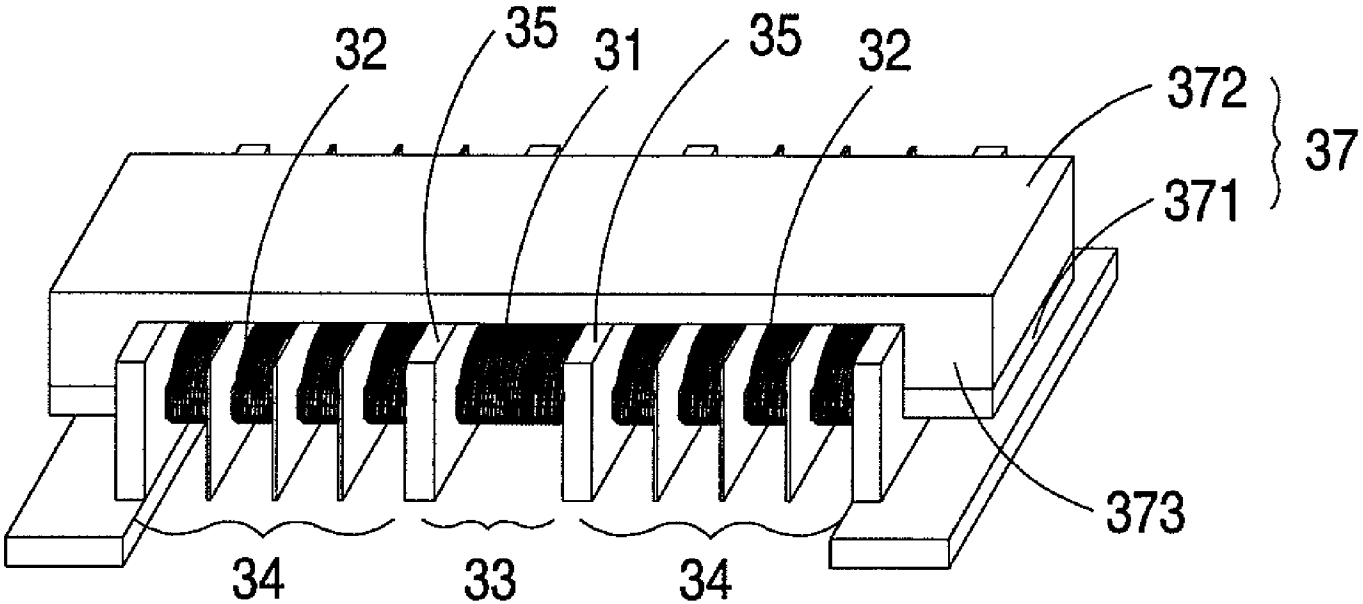

Please refer to FIG. 3(*a*), which is a schematic diagram showing the disassembled structure of the transformer according to the first preferred embodiment of the present invention. As shown in FIG. 3(*a*), the transformer 3 comprises a primary winding coil 31, plural secondary winding coils 32, a first winding portion 33, plural second winding portions 34, plural partition plates 35, a channel 36 and a magnetic core assembly 37. The first winding portion 33 is used for winding the primary winding coil 31 thereon, and the plural second winding portions 34 are used for winding the plural secondary winding coils 31 thereon and disposed at the two sides of the first winding portion 33. The partition plates 35 are disposed between the first winding portion 33 and the second winding portions 34, respectively, and are used for separating the first winding portion 33 and the second winding portions 34, so as to increase the distance between the primary winding coil 31 and the secondary winding coils 32, and increase the leakage inductance of the transformer 3. Each of the partition plates 35 has a slot 351, and in this embodiment, the slot 351 has an opening disposed at the top surface of the partition plate 35, but not limited thereto.

The channel 36 penetrates the first winding portion 33, the second winding portions 34 and the partition plates 35, and has openings at the outer sides of the second winding portions 34, respectively, for disposing partial structure of the magnetic core assembly 37 therein. The magnetic core assembly 37 comprises an I-shaped magnetic core 371 and a U-shaped magnetic core 372. The I-shaped magnetic core 371 can be inserted into the channel 36 from one of the openings at the two outer sides of the second winding portions 34, and pass through the second winding portion 34, the first winding portion 35 and the second winding portion 34 at the other end, and then penetrate out of the opening at the other outer side of the second winding portions 34, so the middle part of the I-shaped magnetic core 371 is received in the channel 36 and the two end parts of the I-shaped magnetic core 371 are exposed outside the openings. The U-shaped magnetic core 372 comprises extensions 373 and protrusions 374, wherein the extensions 373 are disposed at the two ends of the U-shaped magnetic core 372 and extend downwardly, and the protrusions 374 are disposed between the two extensions 373 and also extend downwardly.

When assembling the transformer 3, the I-shaped magnetic core 371 is inserted in the channel 36, the protrusions 374 of the U-shaped magnetic core 372 are inserted into the slots 351 of the partition plates 35 from the upper side so that the U-shaped magnetic core 372 is disposed on the first winding portion 33 and the second winding portions 34, and the two extensions 373 of the U-shaped magnetic core 372 contact with the exposed end parts of the I-shaped magnetic core 371, as shown in FIG. 3(*b*). Thereby, an electromagnetic coupling effect is generated by the interaction of the magnetic core assembly 37, the primary winding coil 31 and the secondary winding coils 32 for voltage regulation.

According to the present invention, the leakage inductance of the transformer 3 can be adjusted through the distance between the protrusion 374 of the U-shaped magnetic core 372 and the I-shaped magnetic core 371 received in the channel 36. Therefore, the protrusion 374 can be designed in different length in accordance with different requirements for the leakage inductance of the transformer 3, so it does not need to redesign the bobbin or the whole structure of the transformer for changing the leakage inductance, so as to reduce the design cost, time and labor.

Figure 4A:
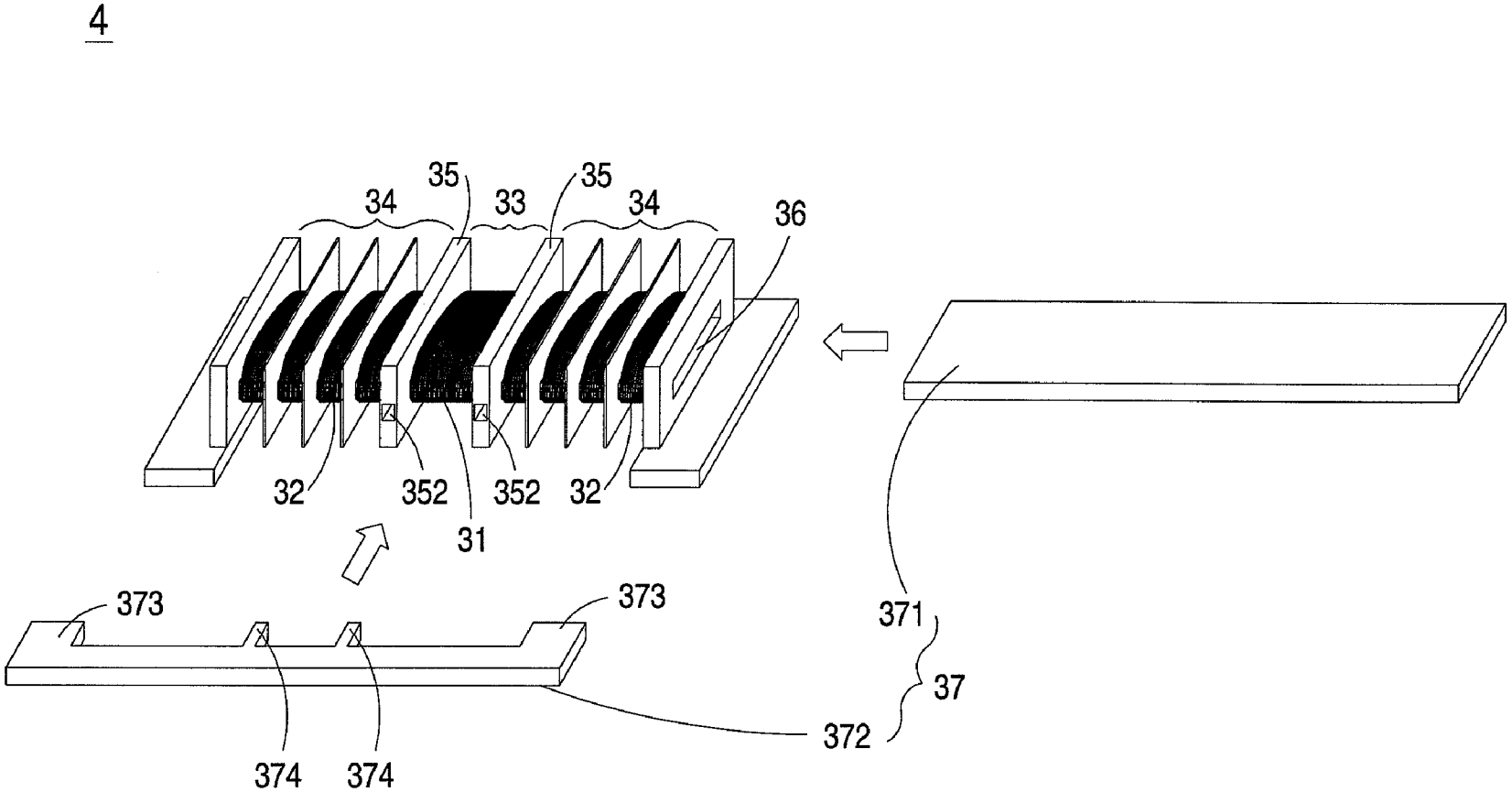
FIG. 4(*a*) is a schematic diagram showing the disassembled structure of the transformer according to the second preferred embodiment of the present invention.
Figure 4B:
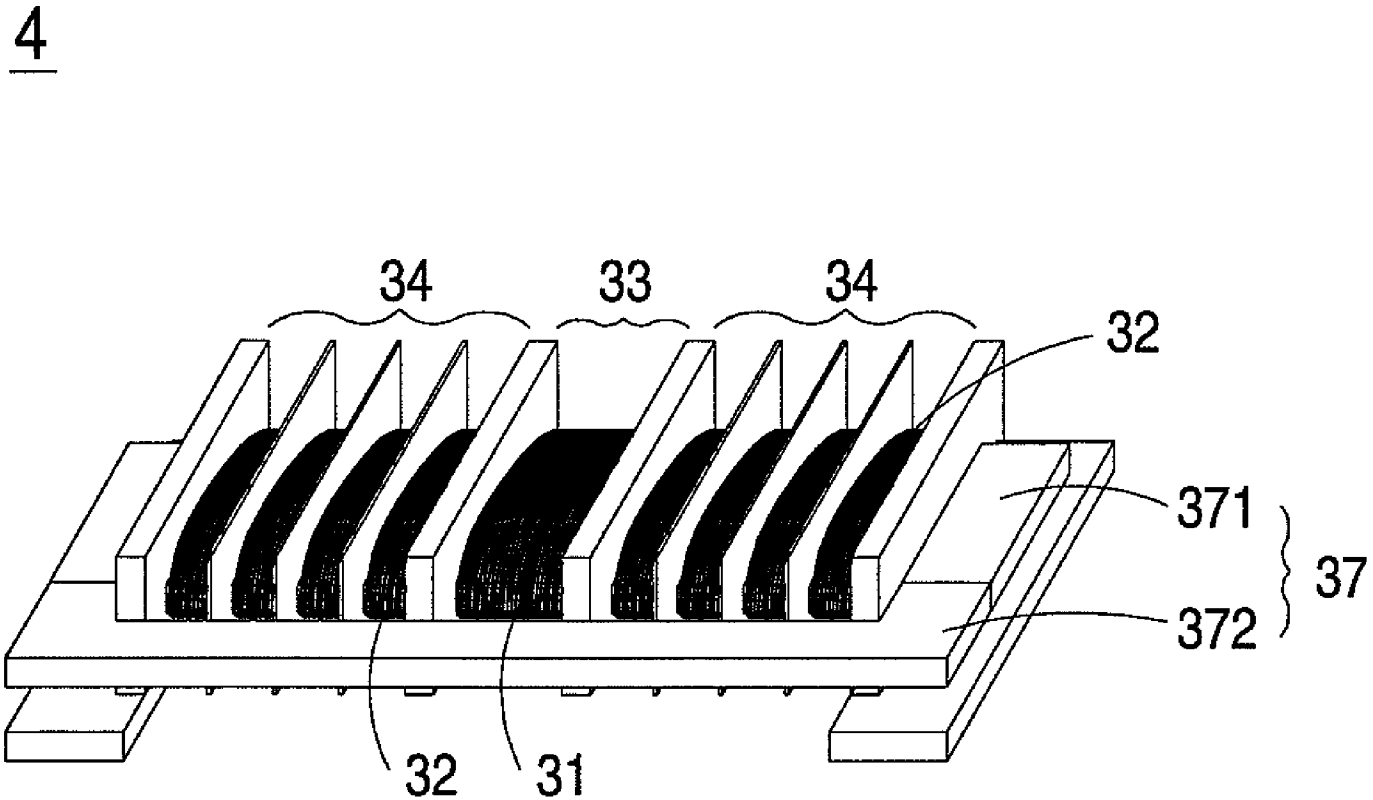

Please refer to FIG. 4(*a*), which is a schematic diagram showing the disassembled structure of the transformer according to the second preferred embodiment of the present invention. As shown in FIG. 4(*a*), the transformer 4 comprises a primary winding coil 31, plural secondary winding coils 32, a first winding portion 33, plural second winding portions 34, plural partition plates 35, a channel 36 and a magnetic core assembly 37. Since the structures, positions and functions of the primary winding coil 31, the plural secondary winding coils 32, the first winding portion 33, the plural second winding portions 34, the plural partition plates 35, the channel 36 and the magnetic core assembly 37 are the same as those of the first embodiment shown in FIG. 3(*a*), they are not redundantly described here.

In this embodiment, the opening of the slot 351 is not disposed on the top surface of the partition plate 35, but disposed at a lateral side surface of the partition plate 35. When assembling the transformer 4, the I-shaped magnetic core 371 is inserted in the channel 36, the protrusions 374 of the U-shaped magnetic core 372 are inserted into the slots 351 from the lateral side and via the openings at the side surfaces of the partition plates 35 so that the U-shaped magnetic core 372 is disposed at the side of the first winding portion 33 and the second winding portions 34, and the two extensions 373 of the U-shaped magnetic core 372 contact with the exposed end parts of the I-shaped magnetic core 371, as shown in FIG. 4(*b*). Thereby, an electromagnetic coupling effect is generated by the interaction of the magnetic core assembly 37, the primary winding coil 31 and the secondary winding coils 32 for voltage regulation.

Figure 5A:
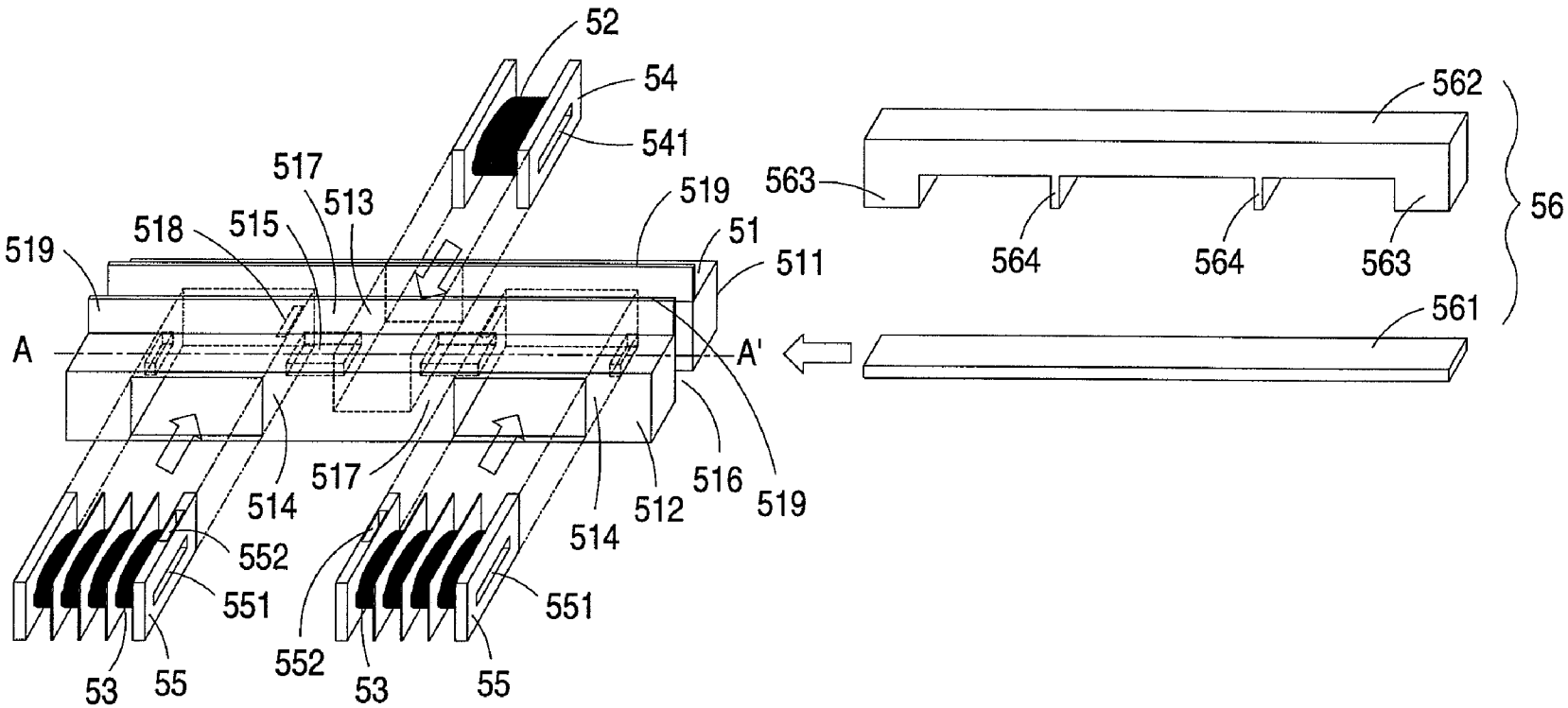
FIG. 5(*a*) is a schematic diagram showing the disassembled structure of the transformer according to the third preferred embodiment of the present invention.
Figure 5B:
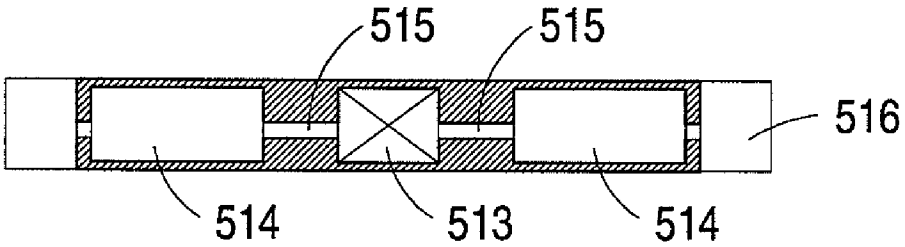
Figure 5C:
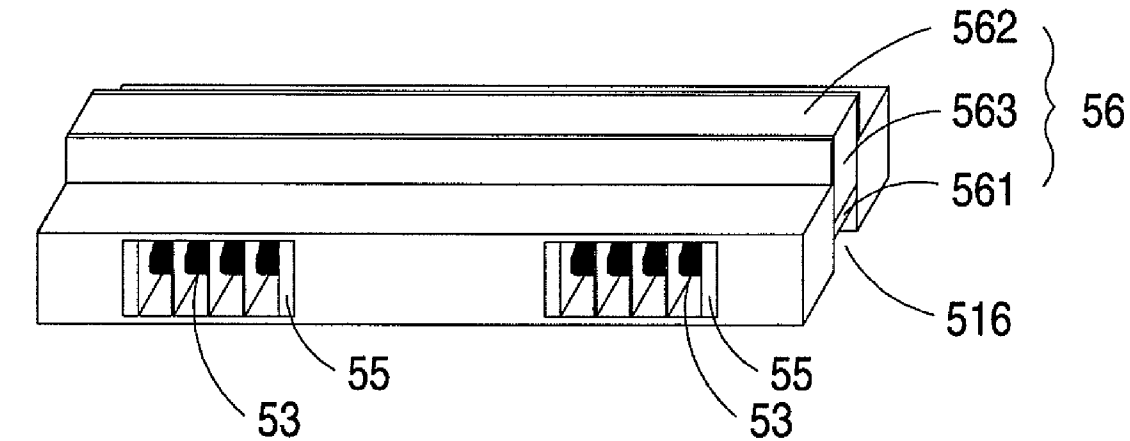

Please refer to FIG. 5(*a*), which is a schematic diagram showing the disassembled structure of the transformer according to the third preferred embodiment of the present invention. As shown in FIG. 5(*a*), the transformer 5 comprises a main body 51, a primary winding coil 52, plural secondary winding coils 53, a first winding portion 54, plural second winding portions 55, and a magnetic core assembly 56.

The main body 51 has a first side 511, a second side 512, a first receptacle 513, plural second receptacles 514, a first channel 515 and plural indentations 516. The first side 511 is opposite to the second side 512. The first receptacle 513 is located in the interior of the main body 51 and has an opening at the first side 511. The two second receptacles 514 are located in the interior of the main body 51 and at the two sides of the first receptacle 513, respectively, and each has an opening at the second side 512.

The first winding portion 54, which is used for winding the primary winding coil 52, is disposed in the first receptacle 513, and has a second channel 541. The two second winding portions 55, which are used for winding the secondary winding coils 53, are disposed in the two second receptacles 514, respectively, and each has a third channel 551 and a slot 552. The first receptacle 513 and the second receptacles 514 are separated by a partition wall 517. The main body 51 further comprises two openings 518 located at the top surface of the main body 51 and close to the partition wall 517, and the two openings 518 communicate with the two second receptacles 514, respectively. When the second winding portions 55 are disposed in the second receptacles 514, the slots 552 of the second winding portions 55 will communicate with the openings 518 on the second receptacles 514.

Since the first receptacle 513 and the second receptacles 514 have the partition wall disposed therebetween and have openings at opposite sides of the main body 51, the creepage distance between the primary winding coil 54 and the secondary winding coils 55 can be lengthened due to the obstruction of the main body 51 when the first winding portion 54 and the second winding portions 55 are disposed in the first receptacle 513 and the second receptacles 514, respectively, so as to enhance the electric safety and increase the leakage inductance.

The magnetic core assembly 56 comprises an I-shaped magnetic core 561 and a U-shaped magnetic core 562. The U-shaped magnetic core 562 comprises extensions 563 and protrusions 564, wherein the extensions 563 are disposed at the two ends of the U-shaped magnetic core 562 and extend downwardly, and the protrusions 564 are disposed between the two extensions 563 and also extend downwardly. The I-shaped magnetic core 561 can be inserted in the first channel 515 of the main body 51 and the second and third channels 541 and 551 of the first and second winding portions 54 and 55 when the first and second winding portions 54 and 55 are disposed in the first and second receptacles 513 and 514, respectively, and the U-shaped magnetic core 562 can be disposed on the main body 51.

Please refer to FIG. 5(*b*), which is a cross-section through the A-A' line in FIG. 5(*a*). As shown in FIG. 5(*b*), the indentations 516 disposed at the two sides of the main body 51 communicate with the openings of the first channel 515, and the first channel 515 communicates with the first receptacle 513 and the second receptacles 514. When the first and second winding portions 54 and 55 are disposed in the first and second receptacles 513 and 514, respectively, the positions of the second and third channels 541 and 551 of the first and second winding portions 54 and 55 are corresponding to the first channel 515 of the main body 51, that is to say, the first channel, the second channel and the third channels communicate with each other.

Please refer to FIG. 5(*c*), which is a schematic diagram showing the assembled structure of the transformer in FIG. 5(*a*). As shown in FIG. 5(*c*), when assembling the transformer 5, the first winding portion 54 with the primary winding coil 52 wound thereon and the second winding portions 55 with the secondary winding coils 53 wound thereon are inserted into the first receptacle 513 and the second receptacles 514, respectively. Subsequently, the I-shaped magnetic core 561 is inserted into the main body 51 through the first channel 51, the third channel 551 and the second channel 541, and the end parts of the I-shaped magnetic core 561 are disposed in the indentations 516. Then the U-shaped magnetic core 562 is assembled with the main body 51 from the upper side, wherein the protrusions 564 are inserted into the slots 552 of the second winding portions 55 through the openings 518 on the second receptacles 514, and the two extensions 563 of the U-shaped magnetic core 562 are also disposed in the indentations 516 and contact with the exposed end parts of the I-shaped magnetic core 561. Thereby, an electromagnetic coupling effect is generated by the interaction of the magnetic core assembly 56, the primary winding coil 52 and the secondary winding coils 53 for voltage regulation.

In addition, the main body 51 further comprises two blocks 519 extending upwardly from the top surface of the main body 51. The two ends of each of the blocks 519 extend to the openings of the indentations 516 for disposing the U-shaped magnetic core 562 therebetween when the main body 51 and the magnetic core assembly 56 are assembled. By means of the blocks 519 disposed on the man body 51, the U-shaped magnetic core 562 can be secured on the main body 51 firmly, so as to enhance the structural stability of the transformer 5.

In conclusion, the present invention employs the partition plate or the partition wall in the main body to separate the primary winding coil and the secondary winding coil and increase the distance between the primary winding coil and the secondary winding coil, so that the leakage inductance of the transformer can be increased. Moreover, the leakage inductance of the transformer can be adjusted through the distance between the protrusions of the U-shaped magnetic core and the I-shaped magnetic core received in the channel. Therefore, the protrusion can be designed in different length in accordance with different requirements for the leakage inductance of the transformer, so it does not need to redesign the bobbin or the whole structure of the transformer for changing the leakage inductance, so as to reduce the design cost, time and labor.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer, comprising:

a primary winding coil;

plural secondary winding coils;

a first winding portion for winding said primary winding coil thereon;

plural second winding portions for winding said secondary winding coils thereon and disposed at two sides of said first winding portion;

plural partition plates disposed between said first winding portion and said second winding portions, respectively, and each said partition plate having a slot;

a channel penetrating said first winding portion, said second winding portions and said partition plates; and a magnetic core assembly comprising an I-shaped magnetic core and a U-shaped magnetic core, said I-shaped magnetic core being received in said channel and said U-shaped magnetic core having plural protrusions inserted into said slots of said partition plates;

thereby a leakage inductance of said transformer is adjusted by a distance between said protrusions of said U-shaped magnetic core and said I-shaped magnetic core received in said channel.

2. The transformer according to claim 1 wherein said slot of said partition plate has an opening on a top surface of said partition plate.

3. The transformer according to claim 2 wherein said protrusions of said U-shaped magnetic core are inserted into said slots from an upper side of said partition plates and disposed on said first winding portion and said second winding portions.

4. The transformer according to claim 1 wherein said slot of said partition plate has an opening on a lateral side surface of said partition plate.

5. The transformer according to claim 4 wherein said protrusions of said U-shaped magnetic core are inserted into said slots from a lateral side of said partition plates and disposed at a side of said first winding portion and said second winding portions.

6. The transformer according to claim 1 wherein said U-shaped magnetic core comprises two extensions disposed at two ends of said U-shaped magnetic core and contacting with two end parts of said I-shaped magnetic core.

7. The transformer according to claim 6 wherein said protrusions are disposed between said extensions.

8. A transformer, comprising:

a main body comprising a first side, a second side, a first channel, a first receptacle communicating with said first side, plural second receptacles communicating with said second side, and plural openings, said second receptacles being disposed at two sides of said first receptacle, and a partition wall being disposed between said first receptacle and said second receptacles;

a primary winding coil;

plural secondary winding coils;

a first winding portion for winding said primary winding coil thereon, said first winding portion being disposed in said first receptacle and having a second channel communicating with said first channel;

plural second winding portions for winding said secondary winding coils thereon and disposed in said second receptacles, each said second winding portion having a third channel communicating with said first channel and a slot communicating with said opening of said main body; and a magnetic core assembly comprising an I-shaped magnetic core and a U-shaped magnetic core, said I-shaped magnetic core being received in said first, second and third channels, and said U-shaped magnetic core having plural protrusions inserted into said slots of said second winding portions through said openings of said main body;

thereby a leakage inductance of said transformer is adjusted by a distance between said protrusions of said U-shaped magnetic core and said I-shaped magnetic core received in said first, second and third channels.

9. The transformer according to claim 8 wherein said first side is opposite to said second side.

10. The transformer according to claim 8 wherein said U-shaped magnetic core comprises two extensions disposed at two ends of said U-shaped magnetic core.

11. The transformer according to claim 10 wherein said protrusions are disposed between said extensions.

12. The transformer according to claim 10 wherein said main body comprises plural indentations disposed at two sides of said main body and communicating with said first channel.

13. The transformer according to claim 12 wherein two end parts of said I-shaped magnetic core are disposed in said indentations, and said extensions of said U-shaped magnetic core are disposed in said indentations and contacting with said two end parts of said I-shaped magnetic core.

14. The transformer according to claim 12 wherein said main body further comprises plural blocks extending upwardly from a top surface of said main body for disposing said U-shaped magnetic core therebetween.

15. The transformer according to claim 14 wherein two ends of each said block extend to openings of said indentations.

* * * * *